US012599282B2

(12) United States Patent
Carlson et al.

(10) Patent No.: US 12,599,282 B2
(45) Date of Patent: Apr. 14, 2026

(54) DISH RACK AND WARE WASHING SYSTEM FOR REUSABLE PLASTIC WARES

(71) Applicant: Ecolab USA Inc., Saint Paul, MN (US)

(72) Inventors: Jessica Rose Carlson, Jamestown, NC (US); Jordan Lundberg, Greensboro, NC (US); Stan James Jones, Roscoe, NC (US); Michael Keith Bost, Island Lake, IL (US)

(73) Assignee: Ecolab USA Inc., Saint Paul, MN (US)

( * ) Notice: Subject to any disclaimer, the term of this patent is extended or adjusted under 35 U.S.C. 154(b) by 0 days.

(21) Appl. No.: 18/492,541

(22) Filed: Oct. 23, 2023

(65) Prior Publication Data

US 2024/0130603 A1 Apr. 25, 2024
US 2024/0225414 A9 Jul. 11, 2024

Related U.S. Application Data

(60) Provisional application No. 63/418,614, filed on Oct. 23, 2022.

(51) Int. Cl.
*A47L 15/50* (2006.01)
*A47L 15/24* (2006.01)

(52) U.S. Cl.
CPC ..... *A47L 15/501* (2013.01); *A47L 15/24* (2013.01); *A47L 15/50* (2013.01)

(58) Field of Classification Search
CPC ..... A47L 15/501
See application file for complete search history.

(56) References Cited

U.S. PATENT DOCUMENTS 3,252,582 A 5/1966 Sol et al.
4,832,206 A 5/1989 Cunningham
5,201,826 A 4/1993 Zimmermann
(Continued)

FOREIGN PATENT DOCUMENTS

EP 1287780 A2 * 3/2003 ..... A47L 15/501
KR 200377671 Y1 * 3/2005

OTHER PUBLICATIONS

Ecolab, "Warewashing & Laundry Equipment by Ecolab Improved Results, Safety and Efficiency", Published 2017, pp. 1-40.
(Continued)

*Primary Examiner* — Kaj K Olsen
*Assistant Examiner* — Richard Z. Zhang
(74) *Attorney, Agent, or Firm* — Fredrikson & Byron, P.A.

(57) ABSTRACT

A dish rack for cleaning reusable plastic dishware can include a bottom support wall, a sidewall defining an outer frame, and a cover positionable over the bottom support wall. In some examples, the dish rack includes spaced-apart prongs extending upwardly from the bottom support wall. In use, an operator can load reusable plastic dishware on or between the prongs of the dish rack and close the cover. This can enclose the reusable plastic in a space bounded between the bottom support wall, the sidewall defining the frame, and the cover. Once loaded, the operator can insert the dishrack into the dishwasher to clean the reusable plastic dishware while retained in the dish rack. The dish rack can allow the reusable plastic dishware to be properly cleaned while minimizing or eliminating problems associated with the comparatively light reusable plastic dishware moving in response to high pressure water within the dishwasher.

14 Claims, 3 Drawing Sheets

(56) References Cited

U.S. PATENT DOCUMENTS

| | | | | |
|---|---|---|---|---|
| 5,497,890 | A | 3/1996 | Clark | |
| 5,857,473 | A | 1/1999 | Vanover et al. | |
| 7,665,475 | B2 | 2/2010 | Hedstrom et al. | |
| 7,901,518 | B2 | 3/2011 | Berner et al. | |
| 9,549,659 | B2 | 1/2017 | Jensen et al. | |
| 10,722,101 | B2 | 7/2020 | Blanchard et al. | |
| 10,905,305 | B2 | 2/2021 | Monsrud et al. | |
| 2008/0156358 | A1 | 7/2008 | Shin et al. | |
| 2008/0302740 | A1 | 12/2008 | Moser et al. | |
| 2009/0050587 | A1* | 2/2009 | Sandor | A47L 15/0065 211/74 |
| 2011/0253648 | A1 | 10/2011 | Clores | |
| 2013/0220954 | A1 | 8/2013 | Williams | |
| 2013/0233353 | A1 | 9/2013 | Vacca et al. | |
| 2014/0224696 | A1* | 8/2014 | Domenech Grau | A47L 15/501 206/459.5 |
| 2020/0008648 | A1 | 1/2020 | Feddema et al. | |
| 2021/0076898 | A1* | 3/2021 | Smith | A47L 15/0028 |
| 2021/0369076 | A1 | 12/2021 | Mcginness et al. | |

OTHER PUBLICATIONS

International Search Report, "International Search Report and Written Opinion", Application No. PCT/US2023/077553, mailed Jan. 16, 2024, pp. 1-14.

* cited by examiner

DISH RACK AND WARE WASHING SYSTEM FOR REUSABLE PLASTIC WARES

RELATED APPLICATION

This application claims priority to U.S. Provisional Application No. 63/418,614, filed on Oct. 23, 2022, the entire contents of which are incorporated herein by reference.

TECHNICAL FIELD

This disclosure relates to ware washing and, more particularly, to dish racks for washing reusable plastic wares.

BACKGROUND

Automated cleaning machines are used in restaurants, healthcare facilities, and other locations to clean, disinfect, and/or sanitize various articles. In a restaurant or food processing facility, automated cleaning machines (e.g., ware wash machines or dish machines) may be used to clean food preparation and eating articles, such as dishware, glassware, pots, pans, utensils, food processing equipment, and other items. In general, articles to be cleaned are placed on a rack and provided to a wash chamber of the automated cleaning machine. In the chamber, one or more cleaning products and/or rinse agents are applied to the articles during a cleaning process. The cleaning process may include one or more wash phases and one or more rinse phases. At the end of the cleaning process, the rack is removed from the wash chamber. Clean items are removed from the rack and replaced with soiled items to start a further wash cycle.

Restaurants serving prepared food typically offer either reusable dishware and eating utensils (e.g., ceramic plates, glassware, stainless steel utensils) or disposable dishware and eating utensils (e.g., paper, cardboard, Styrofoam, and/or plastic dishware and eating utensils). Increasing environmental and regulatory awareness of the impact of using disposable dishware and eating utensils is causing operators that would traditionally use disposable goods to explore alternative reusable solutions that have a reduced environmental impact. Reusable plastic dishware and eating utensils is one solution that provides a reusable alternative to disposable goods while providing a more robust and cost effective product than reusable dishware and eating utensils found in a traditional sit-down restaurant. However, these plastic items need to be cleaned between uses.

SUMMARY

In general, this disclosure is directed to dish racks for cleaning reusable plastic dishware and associated systems and methods utilizing such dish racks. In practice, it has been observed that reusable plastic dishware cleaned in commercial-style dishwashers may move around and knock against each other within the dishwasher as the plastic dishware is contacted with high pressure water. The reusable plastic dishware typically has a lower weight than traditional reusable dishware cleaned in commercial-style dishwashers. As a result, reusable plastic dishware may crack or break while being cleaned in the dishwasher. In other cases, the reusable plastic dishware may scratch or mare, creating surface defects that are visually undesirable and that provide recesses for contaminant collection and growth.

In accordance with examples of the present disclosure, a dish rack for cleaning reusable plastic dishware is described that is configured to securely retain the reusable plastic dishware in the dish rack during the cleaning process within the dishwasher. The dish rack can include a bottom support wall, a sidewall defining an outer frame, and a cover positionable over the bottom support wall. In some examples, the dish rack includes spaced-apart prongs extending upwardly from the bottom support wall.

In use, an operator can load reusable plastic dishware in the dish rack by positioning the reusable plastic dishware over and/or between the prongs. With the reusable plastic loaded onto the dish rack, the operator can close the cover on the dish rack, enclosing the reusable plastic in a space bounded between the bottom support wall, the sidewall defining the frame, and the cover. Once loaded, the operator can insert the dishrack into the dishwasher to clean the reusable plastic dishware while retained in the dish rack. When so configured, the combination of the prongs controlling the spacing of the reusable plastic dishware and the cover retaining the reusable plastic dishware in the enclosed space can prevent excessive movement of the dishware and/or dishware-to-dishware contact during cleaning within the dishwasher. This can allow the dishware to be properly cleaned by the dishwasher while minimizing or eliminating problems associated with the comparatively light reusable plastic dishware moving in response to being contacted with high pressure water within the dishwasher.

In one example, a dish rack for washing reusable plastic wares is described. The dish rack includes a bottom support wall, a plurality of spaced-apart prongs, one or more sidewalls, and a cover. The example specifies that the plurality of spaced-apart prongs extend upwardly from the bottom support wall to a terminal end and that the prongs are configured to receive dishware inserted over and/or between the prongs. The example also specifies that the one or more sidewalls are connected to the bottom support wall and form an outer frame. The one or more sidewalls have a height extending above the terminal end of the plurality of spaced-apart prongs. In addition, the cover is positionable over the bottom support wall to enclose dishwash inserted over and/or between the spaced-apart prongs in a space bounded between the bottom support wall, the one or more sidewalls, and the cover.

In another example, a method of washing reusable plastic wares is described. The method includes positioning one or more reusable plastic dishware articles over and/or between prongs of a dish rack, where the dish rack includes one or more sidewalls forming an outer frame. The method also includes positioning a cover over the one or more reusable plastic dishware articles thereby enclosing the one or more reusable plastic dishware articles in a space bounded by the one or more sidewalls and the cover. The method can further involve inserting the dish rack carrying the one or more reusable plastic dishware articles into a wash chamber of a dishwasher.

In another example, a dishwashing system is described that includes a dishwasher that includes a wash chamber and a spray system for spraying liquid in the wash chamber and a dish rack insertable into and removable from the wash chamber of the dishwasher. The dish rack includes a bottom support wall, a plurality of spaced-apart prongs, one or more sidewalls, and a cover. The example specifies that the plurality of spaced-apart prongs extend upwardly from the bottom support wall to a terminal end and that the prongs are configured to receive dishware inserted over and/or between the prongs. The example also specifies that the one or more sidewalls are connected to the bottom support wall and form an outer frame. The one or more sidewalls have a height extending above the terminal end of the plurality of spaced-apart prongs. In addition, the cover is positionable over the bottom support wall to enclose dishwash inserted over and/or between the spaced-apart prongs in a space bounded between the bottom support wall, the one or more sidewalls, and the cover.

The details of one or more examples are set forth in the accompanying drawings and the description below. Other features, objects, and advantages will be apparent from the description and drawings, and from the claims.

DETAILED DESCRIPTION

Figure 1:
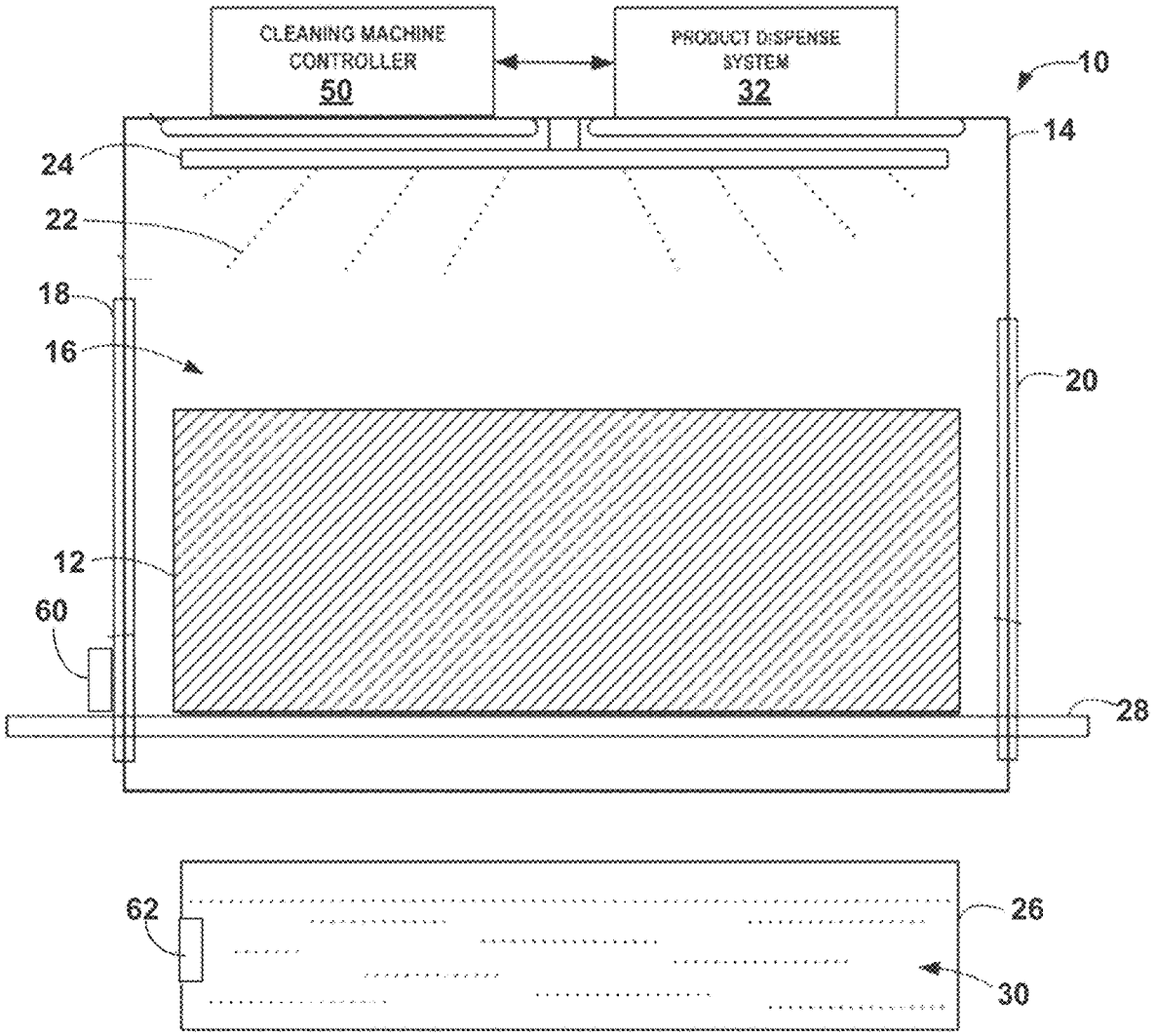
FIG. 1 shows an example automated cleaning machine that can receive a dish rack in accordance with various examples of the disclosure containing dishware to be cleaned, such as reusable plastic dishware to be cleaned.

This disclosure is generally directed to dish racks for cleaning reusable plastic dishware. Example dishware that may be cleaned using a dish rack according to the disclosure includes eating and/or food preparation articles such as plates, bowls, cups (e.g., drinking glasses, coffee cups, wine glasses), eating utensils (e.g., forks, spoons, knives), cooking utensils, pots and pans, trays, and/or other articles used to prepare, serve, and/or consume food. In some examples, one or more (optionally all) of the dishware articles cleaned using a dish rack according to the disclosure are fabricated from plastic. For example, the dishware may be fabricated from polypropylene, melamine, Tritan™ (a copolymer made from dimethyl terephthalate (DMT), cyclohexanedimethanol (CHDM), and 2,2,4,4-tetramethyl-1,3-cyclobutanediol (CBDO)), polycarbonate, and/or other plastic material. In some examples, one or more (optionally all) of the dishware articles have a weight less than 1000 grams, such as less than 500 grams, less than 350 grams, less than 250 grams, or less than 150 grams. In either case, one or more of the dishware articles may be configured and intended to be reused multiple times, with washing between each use, before being recycled or disposed.

While the dish racks described herein are generally described as having particular utility for cleaning reusable plastic dishware, it should be appreciated that the disclosure is not limited to using the dish rack to clean reusable plastic dishware unless otherwise specified. For example, in other applications, the dish rack may be used to clean dishware fabricated from other materials, such as glass, metal, and/or ceramic. The dish rack may be used to clean dishware fabricated from these other materials in addition to cleaning reusable plastic dishware (e.g., by loading dishware of mixed material into the same dishrack) or in lieu of cleaning reusable plastic dishware.

Independent of the composition of the specific dishware articles being cleaned using the dish rack, a dish rack according to the disclosure may be configured to receive and securely retain the dishware in the dish rack. For example, the dish rack may be configured to constrain movement of the dishware once placed in the dish rack, helping to restrict movement of the dishware in the dish rack while being washed in a dish washer. This can help prevent different pieces of dishware from banging into each other and/or piece of dishware from being pushed out of the dish rack while being washed within the dish washer.

In some example, the dish rack includes a bottom support having multiple opening extending therethrough through which water can enter and/or exit during washing. The dish rack may also include multiple upwardly extending prongs spaced apart from each other extending above the bottom support wall. An outer perimeter frame can partially or fully surround the upwardly extending prongs. The top surface of the frame may extend above the top surface of the prongs, e.g., such that the end of the prongs are positioned below the top surface of the frame. A cover that can be opened and closed can be positioned over the upwardly extending prongs. For example, the cover may have an area partially or fully covering a corresponding area of the bottom support surface into which dishware is intended to be inserted. In some examples, the cover is hingedly attached to one side of the frame and includes a lock operable to releasably secure the cover to an opposite side of the frame. In use, an operator can insert dishware over and/or between the upwardly extending prongs of the dish rack, close and lock the cover over the prongs and dishware inserted thereon and/or therebetween, and inert the loaded and closed dish rack into a dishwasher.

FIG. 1 shows an example automated cleaning machine 10 that can receive a dish rack 12 in accordance with various examples of the disclosure containing dishware to be cleaned, such as reusable plastic dishware to be cleaned. In the illustrated example, cleaning machine 10 is illustrated as a ware wash or dishwasher machine configured to clean and/or sanitize dishware that can include eating and/or food preparation articles as described above. Accordingly, cleaning machine 10 will also be referred to as dishwasher 10.

In use, dish rack 12 may be removed from dishwasher 10 and loaded with soiled dishware to be cleaned and/or sanitized using the dishwasher. Soiled dishware may contain residual food and/or beverage residue. For example, an operator may physically remove dish rack 12 such that the dish rack is not physically attached to or located in dishwasher 10 (e.g., by moving the dish rack to a separate counter location). After loading dish rack 12 with soiled dishware, the operator can move the dish rack to dishwasher 10 and insert the loaded dish rack into the dishwasher for processing inside of the dishwasher. Dish rack 12 can have a variety of different design features as will be described in greater detail with respect to FIGS. 2A and 2B.

Dishwasher 10 in FIG. 1 includes an enclosure 14 defining one or more wash chamber(s) 16 and having one or more door(s) 18, 20 that permit entry and/or exit into wash chamber 16. One or more removable dish rack(s) 12 are sized to fit inside wash chamber 16. Each dish rack 12 may be configured to receive articles to be cleaned directly thereon, or they may be configured to receive one or more trays or holders into which articles to be cleaned are held during the cleaning process.

A typical dishwasher such as dishwasher 10 can operate by spraying one or more cleaning solution(s) 22 (a mixture of water and one or more chemical cleaning products) into wash chamber 16 and thus onto the articles to be cleaned. The cleaning solution(s) are pumped to one or more spray arms 24, which spray the cleaning solution(s) 22 into wash chamber 16 at appropriate times. Dishwasher 10 is provided with a source of fresh water and, depending upon the application, may also include one or more sumps, such as sump 26, to hold used wash and/or rinse solution 30 to be reused in the next cleaning cycle. Dishwasher 10 may also include or be provided with a chemical product dispenser 32 that automatically dispenses the appropriate chemical product(s) at the appropriate time(s) during the cleaning process, mixes them with the diluent, and distributes the resulting cleaning solution(s) to dishwasher 10 to be dispensed into wash chamber 16. Depending upon the machine, the articles to be cleaned, the amount of soil on the articles to be cleaned, and other factors, one or more wash phases may be interspersed with one or more rinse phases and/or sanitization phases to form one complete cleaning process of dishwasher 10.

When configured as a commercial dishwasher for institutional operators, dishwasher 10 may be configured for loading and unloading wash chamber 16 with batches of items to be washed. In front-loader or hood-type dishwasher configuration, the items to be washed are placed in dish rack 12 and dish rack loaded with items to be washed is placed in the wash chamber 16 through a front door 18 and, after cleaning, is removed again through the front door. In a tunnel-type dishwasher configuration, dish racks 12 loaded with items to be washed can be conveyed into wash chamber 16 (e.g., manually or via a conveyor belt 28) from an entry side 18 and removed from the wash chamber from an exit side 20 (e.g., manually or via conveyor belt 28) when a washing program is complete. Typical commercial dishwasher configurations can operate with much faster cycle times than domestic dishwashers (e.g., a washing program that includes at least one cleaning cycle and at least one final rinse cycle lasting less than 5 minutes; a drying cycle lasting less than 10 minutes).

Independent of the specific configuration of dishwasher 10, the dishwasher may include a dishwasher controller 50. Controller 50 can include one or more processor(s) that monitor and control various parameters of dishwasher 10 such as wash and rinse phase time(s) and duration(s), cleaning solution concentrations, timing dispensation of one or more chemical products, amounts of chemical products to be dispensed, wash and/or rinse phase water temperature(s), timing for application of water and chemical products into the wash chamber, etc. Controller 50 may communicate with product dispense system 32 in order to monitor and/or control the timing and/or amounts of cleaning products dispensed into dishwasher 10.

In some implementations, dishwasher 10 includes a non-contact reader 60 communicatively coupled to controller 50. Non-contact reader 60 can be configured to read information stored on a non-contact tag carried by dish rack 12. For example, dish rack 50 can carry a machine-readable tag 62 configured to be read by non-contact reader 60. In various examples, non-contact reader 60 can be implemented as a near field communication (NFC) reader, a radio frequency identification (RFID) reader, an optical reader, and/or yet other type of reader operable to read information stored on machine-readable tag 62 carried by machine-readable tag 62.

Independent of the specific configuration of non-contact reader 60, the reader can read information stored on the machine-readable tag 62 carried by dish rack 12. The tag 62 may be adhered to a surface of dish rack 12, embedded within a material forming the dish rack, or otherwise temporarily or permanently affixed to the dish rack. The tag can contain information identifying the dish rack as one being configured for receiving and washing reusable plastic wares. The identifying information may be in the form of a numeric code, manufacturers name or brand, or other information identifying the origin and/or type and/or configuration of dish rack to which the machine-readable tag is attached. Additionally or alternatively, the tag can contain information concerning the wash and/or drying parameters to be used by dishwasher 10 when washing items placed in dish rack 12 (e.g., water temperature, water pressure, wash duration, number and configuration of cycles, amount and/or type of chemistry to be used, dry time).

Controller 50 can control non-contract reader 60 to read the information from the machine-readable tag present on dish rack 12, e.g., as the dish rack is place in dishwasher 10 and machine-readable tag 62 is in sufficiently close proximity to be read by non-contract reader 60. Controller 50 can control dishwasher 10 in response to information read by non-contract reader 60. For example, controller 50 may control the water temperature, water pressure, wash duration, number and configuration of cycles, amount and/or type of chemistry to be used, fresh mater make up, dry time, and/or other wash and/or dry parameters of dishwasher 10 based on information read from machine-readable tag 62 by non-contract reader 60. In some examples, controller 50 controls dishwasher 10 by extending a wash cycle duration, decreasing water pressure during a wash cycle, decreasing a wash cycle temperature, and/or increasing a drying time in response to detecting that reusable plastic items are to be washed based on information read from machine-readable tag 62 as compared to the parameter(s) otherwise used when washing items other than reusable plastic items (e.g., ceramic, metal, glass).

Figure 2A:
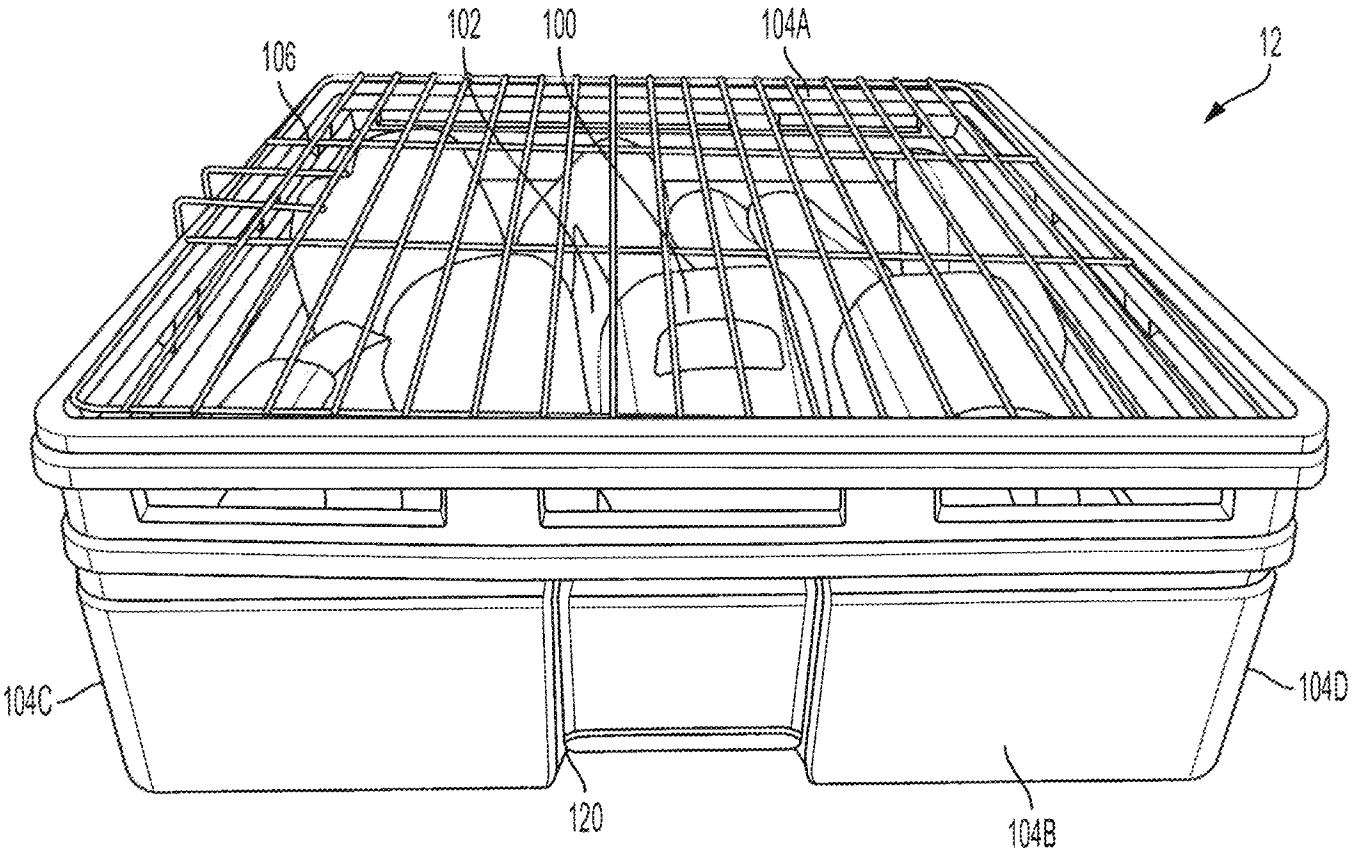
FIG. 2A is a perspective view of an example dish rack showing the dish rack closed with example dishware loading into the dish rack.
Figure 2B:
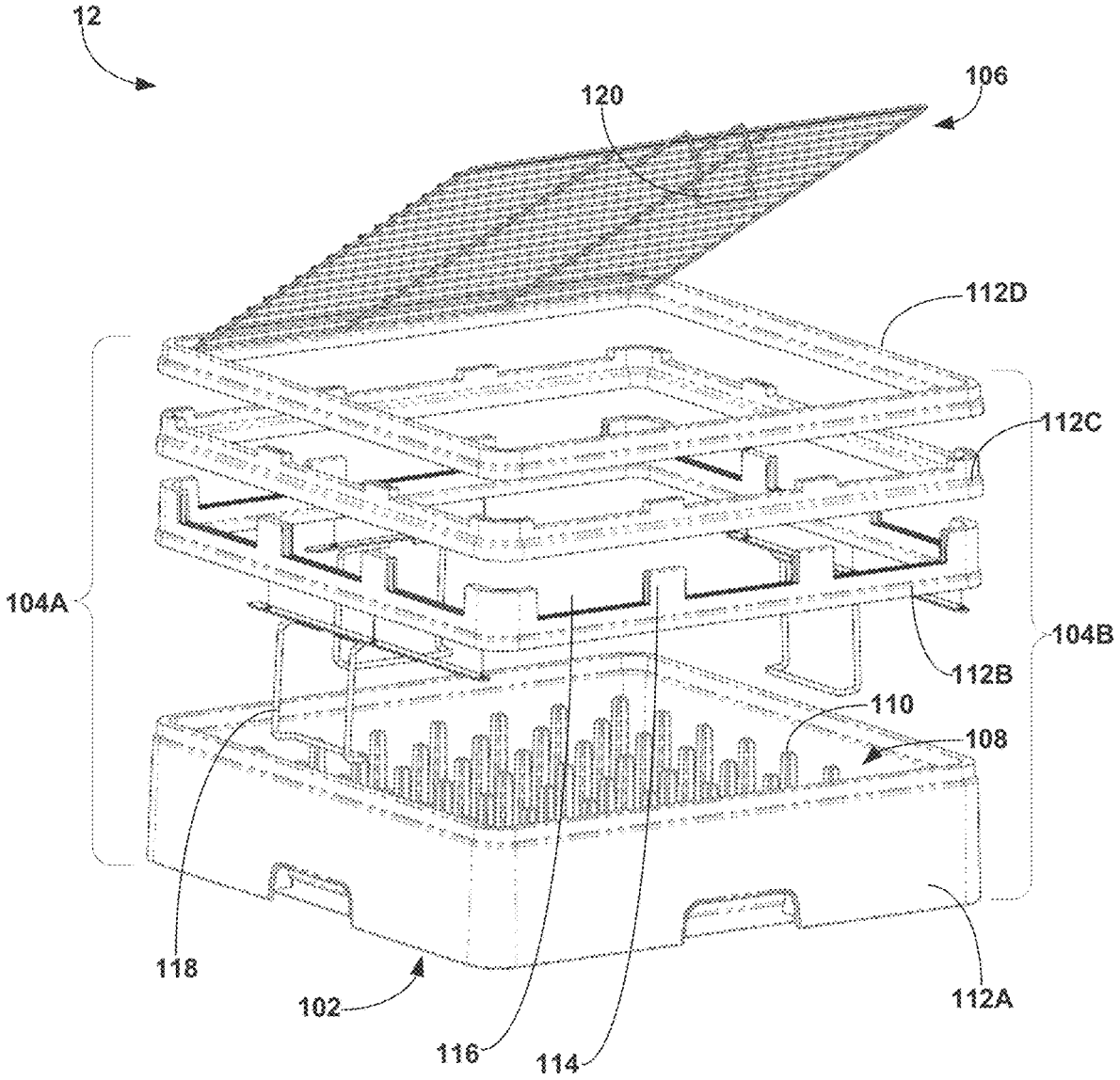
FIG. 2B is an exploded perspective view of an example dish rack shown without dishware loaded into the dish rack.

FIGS. 2A and 2B (collectively referred to as "FIG. 2") are images of different configurations of an example dish rack 12 that can receive soiled dishware and that can be inserted into a wash chamber of a dishwasher to wash the soiled dishware, such as wash chamber 16 of dishwasher 10 in FIG. 1. FIG. 2A is a perspective view of dish rack 12 showing the dish rack closed with example dishware 100 loading into the dish rack. FIG. 2B is an exploded perspective view of dish rack 12 shown without dishware 100 loaded into the dish rack.

In the configuration of FIG. 2, dish rack 12 is illustrated as having a bottom support wall 102, one or more sidewalls 104A-104D (collectively referred to as "sidewall 104"), and a cover 106. In the illustrated arrangement, dish rack 12 also includes a plurality of spaced-apart prongs 108 (FIG. 2B). Prongs 108 extending upwardly relative to bottom support wall 102. In use, an individual washing dishware 100 can open cover 106, position the dishware over and/or between prongs 108, and closed cover 106 over the dishware inserted onto dish rack 12. After loading the dish rack, the user can transfer the loaded dish rack into wash chamber 16 of dishwasher 10 (FIG. 1) to wash dishware 100 while retained by the dish rack.

In general, bottom support wall 102 of dish rack 12 may be a wall surface defining a bottommost extent of the dish rack. Bottom support wall 102 may be a planar surface from which sidewall 104 extends upwardly. In typical applications, bottom support wall 102 may have multiple openings extending through the thickness of the support wall to allow liquid ingress and egress during the washing process. For example, bottom support wall 102 may define a grid of intersecting bars of material with openings formed between adjacent bars. That said, in other configurations, bottom support wall 102 may define a solid surface devoid of openings.

In some configurations, including the configuration of FIG. 2, dish rack 12 includes prongs 108. Prongs 108 can be spaced apart from each other and can extend upwardly relative to bottom support wall 102. In some examples, prongs 108 can have a length extending from a first end where each prong is joined to the top surface of bottom support wall 102 to a second end 110 (which may also be referred to as a terminal end) located farther away from the bottom support wall than the first end. In some implementations, each prong 108 is connected to bottom support wall 102. In other implementations, one or more of prongs 108 may extend upwardly away from bottom support wall 102 without being directly connected to the bottom support wall (e.g., by extending from a structure connected to sidewall 104).

At least some, and optionally all, of prongs 108 may be arranged in rows such that a passage may be defined between the rows lengthwise and/or widthwise across dish rack 12. In some examples, one or more (optionally all) of prongs 108 extend at a right angle (90 degrees) with respect to bottom support wall 102. Additionally or alternatively one or more prongs 108 may angled (extend at an angle less than or greater than 90 degrees) relative to bottom support wall 102. The angle of prongs 108 relative to bottom support wall 102 may be fixed (e.g., such that the angle cannot be adjusted by a user) or may be adjustable by a user to provide variable angles. As shown, prongs 108 are arranged spaced-apart from each other in rows extending across the entire surface of bottom support wall 102. In alternative configurations, prongs 108 may only be located on a portion of bottom support wall 102 (e.g., to provide an adjacent region of the bottom support wall devoid of prongs that can separately receive dishware to be cleaned, such as larger dishware that does not conveniently fit on or over prongs 108).

The size and spacing of prongs 108 can vary depending on the desired application. In some configurations, each prong 108 can have a length extending from bottom support wall 102 to the terminal end 110 within a range from 12.5 mm to 250 mm, such as from 25 mm to 100 mm, or from 50 mm to 75 mm. Each prong 108 of dish rack 12 may have the same length, or different prongs may have different lengths. For example, at least some prongs 108 may be longer than at least some other prongs 108, providing variable height options to accommodate placement of different dishware in dish rack 12.

Each prong may be separated from each other adjacent prong by a spacing measured from the center on one prong to the center of an adjacent prong. In some implementations, the spacing between prongs is within a range from 12.5 mm to 100 mm, such as from 25 mm to 75 mm. The spacing between prongs may be fixed or may be adjustable. For instance, in some configurations, different rows of prongs 108 may be configured to slide or otherwise move relative to each other to allow the user to adjust the spacing between adjacent rows of prongs.

Each prong 108 can have any suitable size and cross-sectional shape. In some examples, each prong has a cross-sectional size (e.g., diameter) within a range from 1 mm to 25 mm, such as from 2 mm to 5 mm, from 5 mm to 10 mm, from 10 mm to 15 mm, from 10 mm to 20 mm, or from 15 mm to 25 mm. In various examples, each prong 108 may have a circular cross-sectional shape, a square cross-sectional shape, or other arcuate and/or polygonal cross-sectional shape.

Dish rack 12 includes sidewall 104. Sidewall 104 can be directed or indirectly connected to bottom support wall 102 and can extend upwardly away from the bottom support wall to define side surfaces of the dish rack providing an outer frame of the dish rack. In some examples, the one or more sidewalls 104 can surround a perimeter of bottom support wall 102 and extend upwardly away from the bottom support wall about the perimeter of the bottom support wall. Sidewall 104 can bound a side extent of dish rack 12 to help retain dishware 100 within the dish rank.

The number and configuration of sidewalls 104 can vary depending on the configuration of dish rack 12. In the illustrated example, dish rack 12 is shown as having four sidewalls: a front sidewall 104A, a backside wall 104B, a first lateral sidewall 104C, and a second lateral sidewall 104D. When so configured, dish rack 12 can define a square or rectangular shape. Dish rack 12 may have a different number of sidewalls, such as a single continuous sidewall (e.g., defining a circular shape), three sidewalls (e.g., defining a triangular shape), six sidewalls (e.g., defining a hexagonal shape), or other suitable number of sidewalls.

Each sidewall 104 may be a solid surface devoid of openings extending through the sidewall, or one or more of the sidewalls may include openings extending through the sidewall. For example, one or more of sidewalls 104 may include openings extending through the thickness of the sidewall to allow ingress and egress of liquid during cleaning. In some implementations, dish rack 12 includes an open side and/or a cutout through one or more sidewalls configured to accommodate larger articles extending out through the open side and/or cutout beyond the perimeter edge of the dish rack.

Each sidewall 104 may be formed of a single section of material defining the overall height of the sidewall or may be formed of multiple sections of material joined together to define the overall height of the sidewall. For example, with reference to FIG. 2B, one or more of the sidewalls 104 of dish rack 12 may be formed by joining a plurality of outer frame segments 112 together. Each outer frame segment 112 may have a shape and/or define a perimeter corresponding to the shape and/or perimeter of dish rack 12 upon assembly. In the illustrated example of FIG. 2B, dish rack 12 is shown as being formed of four frame segments 112A-112D vertically stacked on top of each other to form the resulting sidewalls 104 of dish rack 12. In other examples utilizing joinable segments, dish rack 12 may be formed by joining fewer sidewall segments together (e.g., two or three) or more sidewall segments together (e.g., five, six, or more). Configuring dish rack 12 with joinable sidewall segments can be beneficial to allow the user to change the height of the dish rack depending on their needs and the types of dishware to be inserted into the dish rack.

In various examples, one or more of the outer frame segments 112 may define sidewalls that are solid without openings extending through the thickness of the sidewall or may define one or more sidewalls having an opening extending through the thickness of the sidewall. In the illustrated example, dish rack 12 is illustrated as having a first frame segment 112A and a fourth frame segment 112D having solid sidewall surfaces and a second frame segment 112B in a third frame segment 112C having openings extending through the thickness of the sidewall. In particular, second frame segment 112B and third frame segment 112C are illustrated as including multiple spaced-apart risers 114 with sidewall openings 116 defined between adjacent risers.

To assemble sidewalls 104 when using multiple outer frame segments 112, the different outer frame segments can be stacked vertically together to form a composite structure defining the one or more sidewalls 104. The different frame segments can be permanently attached together after assembly (e.g., using adhesive, heat bonding, or other fixation structure or technique not intended to be removable). Alternatively, the different frame segments can be temporarily connected together, allowing the frame segments to subsequently be detached from each other if desired by the user.

For example, dish rack 12 may include one or more mechanical connectors connecting an upper one of the outer frame segments 112 to a lower one of the outer frame segments 112. Any suitable mechanical connector or combination of mechanical connectors that joins one segment to another frame segment, either directly or indirectly can be used. In some examples, dish rack 12 includes one or more female connectors (e.g., a receiving opening) on an upper one of the outer frame segments 112 or a lower one of the outer frame segments and one or more complementary male connectors (e.g., a projection) on the other of the upper or lower outer frame segments. During assembly, the male connector on one frame segment can be inserted into the female connector on the other frame segment to interconnect and temporarily lock the frame segments together.

Additionally or alternatively, dish rack 12 may include one or more latches 118 extending downwardly from an upper outer frame segments 112 that is configured to latch around a lower one of the frame segments and/or bottom support wall 102. For example, in the illustrated configuration, dish rack 12 includes latch 118 extending downwardly from a bottom surface of second outer frame segment 112B. Latch 118 can be fixedly connected to second outer frame segment 112B. Latch 118 can include a vertical extent configured to span the height of the sidewall of first outer frame segment 112A and a lateral extent configured to be positioned under the sidewall of the first outer frame segment and/or under bottom support wall 102. Dish rack 12 is illustrated being implemented with two latches 118 on opposite sides of the dish rack although can be implemented with a different configuration or arrangement of latches.

Independent of the number of sections joined together to form the one or more sidewalls 104 of dish rack 12, each sidewall may have a height extending from a bottom end to a top end. The height of each sidewall may be sized greater than the length of prongs 108 extending above bottom support wall 102. This can help ensure that dishware placed on and extending above the prongs 108 is below the top of the sidewall 104. This can allow cover 106 to be closed over the dishware placed over and/or between the prongs 108, with the dishware fully enclosed in the space bounded by bottom support wall 102, sidewall 104, and cover 106.

The separation distance between the terminal end 110 of the prongs 108 and the height (e.g., top edge) of the one or more sidewalls 104 may be sufficiently large to allow dishware 100 to be placed on the prongs and cover 106 close over the dishware but may be sufficiently small to limit excessive displacement of dishware in dish rack 12 during washing. In some examples, the separation distance is at least 12.5 mm, such as at least 25 mm, at least 37.5 mm, at least 50 mm, at least 75 mm, or at least 100 mm. Additionally or alternatively, the separation distance may be less than 150 mm, such as less than 100 mm, or less than 75 mm. The separation distance may be within a range bounded by any one of the foregoing lower and upper example limits.

Dish rack 12 in the example of FIG. 2 also includes a cover 106. Cover 106 can be positioned extending over bottom support wall 102 at a location vertically offset a distance defined by the height of sidewall 104. For example, the outer frame defined by sidewall 104 can define an upper opening through which dishware 100 can be inserted into dish rack 12 (e.g., over and/or between the plurality of spaced-apart prongs 108). Cover 106 can extend partially or entirely over the area defined by the upper opening.

Typically, cover 106 includes openings to allow ingress and egress of liquid during washing. For example, cover 106 may be defined by a lattice of crossing strips with open spaces between the crossing strips. In some examples, cover 106 is a wire frame structure.

Cover 106 may be opened and closed to provide access to an interior space of dish rack 12. For example, cover 106 may be fixedly attached to an upper outer frame segment 112D that can be attached to and removed from a lower frame segment to provide access to an interior space of the dish rack. Additionally or alternatively, cover 106 may be hingedly connected to the one or more sidewalls 104.

For example, in the illustrated arrangement, cover 106 is hingedly connected to second lateral side wall 104D. When cover 106 includes a hinged side connected to one of the sidewalls 104, dish rack 12 may include a lock to lock an opposite side of the cover to the dish rack after closing the cover. For example, as illustrated, cover 106 includes a lock 120 on a different side of the cover from the hinged connection. Lock 120 can be configured to releasably lock the cover in a closed position. Lock 120 can engage sidewall 104 and/or bottom support wall 102 to temporarily lock cover 106 in a closed position. For example, lock 120 can include a vertical extent configured to span at least a portion of the height first lateral sidewall 104C a lateral extent configured to be positioned under a portion of the sidewall and/or under bottom support wall 102.

Dish rack 12 can be fabricated from a variety of different materials. Some or all of the portions of dish rack 12 can be fabricated from molded plastic (e.g., bottom support wall 102, sidewall 104, prongs 108). Additionally or alternatively, some or all of the portions of dish rack 12 can be fabricated from metal, such as a wireframe structure. Other types and combinations of materials can be used to fabricate the dish rack.

In use, an operator can open cover 106 and position one or more reusable plastic dishware articles 100 over and/or between prongs 108 of the dish rack 12. With dish rack 12 partially or fully loaded with dishware articles, the operator can position cover 106 over the one or more reusable plastic dishware articles, thereby enclosing the reusable plastic dishware articles in a space bounded by bottom support wall 102, the one or more sidewalls 104, and cover 106. For example, the operator can rotate cover 106 about a hinged connection and engage lock 120 to lock the cover and a closed position.

After loading and locking dish rack 12, the operator can insert the dish rack carrying the one or more reusable plastic dishware articles into wash chamber 16 of dishwasher 10. For example, the operator can open a front closure of dishwasher 10, insert dish rack 12 into wash chamber 16, and close the front closure before initiating a wash cycle. Alternatively, the operator can position dish rack 12 on conveyor belt 28 to be conveyed into wash chamber 16 of dishwasher 10 before initiating a wash cycle.

It should be appreciated that the descriptive terms "top" and "bottom" or "upper" and "lower" with respect to the configuration and orientation of components described herein are used for purposes of illustration based on the orientation in the figures. The arrangement of components in real world application may vary depending on their orientation with respect to gravity. Accordingly, unless otherwise specified, the general terms "first" and "second" may be used interchangeably with the terms "top" and "bottom" without departing from the scope of disclosure.

Various examples have been described. These and other examples are within the scope of the following claims.

The invention claimed is:

1. A method of washing reusable plastic wares, the method comprising:

positioning one or more reusable plastic dishware articles over and/or between prongs of a dish rack, the dish rack comprising one or more sidewalls forming an outer frame;

positioning a cover over the one or more reusable plastic dishware articles thereby enclosing the one or more reusable plastic dishware articles in a space bounded by the one or more sidewalls and the cover; and inserting the dish rack carrying the one or more reusable plastic dishware articles into a wash chamber of a dishwasher, wherein the one or more sidewalls forming the outer frame comprise a plurality of outer frame segments, the plurality of outer frame segments being stacked vertically together to form a composite structure defining the one or more sidewalls, wherein a latch connects an upper one of the plurality of outer frame segments to a lower one of the plurality of outer frame segments, the latch extending downwardly from the upper one of the plurality of outer frame segments to latch around the lower one of the plurality of outer frame segments and/or a bottom support wall of a lowest one of the plurality of outer frame segments; and wherein the cover is attached to an uppermost one of the plurality of outer frame segments.

2. The method of claim 1, wherein:

the cover is hingedly attached to the one or more sidewalls and comprises a locking feature; and positioning the cover over the one or more reusable plastic dishware articles comprises rotating the cover closed over the one or more reusable plastic dishware articles and engaging the locking feature to lock the cover in a closed position.

3. The method of claim 1, wherein inserting the dish rack carrying the one or more reusable plastic dishware articles into the wash chamber of the dishwasher comprises one of:

opening a front closure of the dishwasher, inserting the dish rack into the wash chamber, and closing the front closure; or conveying the dish rack along a conveyor line into the wash chamber of the dishwasher.

4. The method of claim 1, further comprising, prior to positioning the one or more reusable plastic dishware articles over and/or between the prongs of the dish rack, stacking the plurality of outer frame segments vertically together to form the composite structure defining the one or more sidewalls.

5. The method of claim 1, wherein:

the outer frame formed by the one or more sidewalls forms an upper opening, and positioning the one or more reusable plastic dishware articles over and/or between the prongs of the dish rack comprises positioning the one or more reusable plastic dishware articles through the upper opening; and positioning the cover over the one or more reusable plastic dishware articles comprises positioning the cover over an entire area of the upper opening.

6. The method of claim 1, wherein the cover comprises a lattice defined by crossing strips with open spaces between the crossing strips.

7. The method of claim 1, wherein positioning the cover over the one or more reusable plastic dishware articles comprises rotating the cover about a hinged connection to the one or more sidewalls to a closed position.

8. The method of claim 1, wherein:

the prongs include a plurality of spaced-apart prongs each having a length extending from the bottom support wall to a terminal end, and the length is within a range from 25 mm to 100 mm; and the one or more sidewalls extend above the terminal end of the plurality of spaced-apart prongs at least 12.5 mm.

9. The method of claim 1, wherein at least one of the outer frame segments comprises a plurality of spaced-apart risers with sidewall openings defined between adjacent risers.

10. The method of claim 1, wherein the cover is attached to the outer frame.

11. The method of claim 1, wherein the dish rack comprises four sides defining a rectangular or a square shape.

12. The method of claim 1, wherein each of the one or more sidewalls is devoid of apertures passing through that sidewall.

13. The method of claim 1, wherein the prongs include a plurality of spaced-apart prongs arranged in rows with a spacing between adjacent prongs being within a range from 12.5 mm to 100 mm.

14. The method of claim 1, wherein the lower one of the plurality of outer frame segments comprises a side wall and a bottom wall, and the latch extends under the bottom wall of the lower one of the plurality of outer frame segments.

* * * * *